US006190811B1

(12) United States Patent
Tanaka et al.

(10) Patent No.: US 6,190,811 B1
(45) Date of Patent: Feb. 20, 2001

(54) ELECTROPHOTOGRAPHIC PHOTOSENSITIVE MEMBER PROCESS CARTRIDGE AND ELECTROPHOTOGRAPHIC APPARATUS

(75) Inventors: Masato Tanaka, Shizuoka-ken; Hideyuki Takai, Yokohama, both of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/363,857

(22) Filed: Jul. 30, 1999

(30) Foreign Application Priority Data

Jul. 31, 1998 (JP) ..... 10-217771
Jul. 31, 1998 (JP) ..... 10-217772

(51) Int. Cl.[7] ..... G03G 5/06
(52) U.S. Cl. ..... 430/78; 399/159
(58) Field of Search ..... 430/78; 540/139; 399/159

(56) References Cited

U.S. PATENT DOCUMENTS

| | | | | |
|---|---|---|---|---|
| 5,246,807 | | 9/1993 | Kanemaru et al. | 430/58 |
| 5,698,359 | | 12/1997 | Yanus et al. | 430/132 |
| 5,756,247 | * | 5/1998 | Tambo et al. | 430/78 |
| 5,834,149 | * | 11/1998 | Tambo et al. | 430/78 |
| 5,910,384 | * | 6/1999 | Yamasaki et al. | 430/78 |

FOREIGN PATENT DOCUMENTS

| | | |
|---|---|---|
| 0482884 | 4/1992 | (EP) . |
| 0803546 | 10/1997 | (EP) . |
| 0823668 | 2/1998 | (EP) . |
| 6-251149 | 9/1994 | (JP) . |
| 7-093561 | 4/1995 | (JP) . |
| 7-225847 | 8/1995 | (JP) . |

OTHER PUBLICATIONS

Chen, et al. "Segmentation . . . Algorithm," Comp. Graphics and Image Processing, vol. 10, pp. 172–182 (1979).

Kass, et al. "Snakes : Active Contour Models"; Int. J. Comp. Vision, vol. 1, No. 4, (1987) pp. 321–331.

* cited by examiner

*Primary Examiner*—John L Goodrow
(74) *Attorney, Agent, or Firm*—Fitzpatrick, Cella, Harper & Scinto

(57) ABSTRACT

An electrophotographic photosensitive member is disclosed which has a support and a photosensitive layer and is exposed to semiconductor laser light having a wavelength of from 380 nm to 500 nm. The photosensitive layer contains a gallium phthalocyanine compound, or an oxytitanium phthalocyanine compound having a strong peak at 27.2° plus-minus 0.2° of the diffraction angle in CuKα characteristic X-ray diffraction. Also, disclosed are a process cartridge and an electrophotographic apparatus making use of the photosensitive member.

27 Claims, 2 Drawing Sheets

ELECTROPHOTOGRAPHIC PHOTOSENSITIVE MEMBER PROCESS CARTRIDGE AND ELECTROPHOTOGRAPHIC APPARATUS

BACKGROUND OF THE INVENTION

1. Field of the Invention

This invention relates to an electrophotographic photosensitive member, a process cartridge and an electrophotographic apparatus, and more particularly to an electrophotographic photosensitive member, a process cartridge and an electrophotographic apparatus which are suited for short-wavelength semiconductor lasers capable of making images have higher resolution.

2. Related Background Art

Lasers used in electrophotographic apparatus making use of lasers as light sources as typified by laser printers are prevailingly semiconductor lasers having oscillation wavelength around 800 nm or around 680 nm. In recent years, various approaches to higher resolution are made with an increase in demand for reproducing images having a higher image quality. Wavelengths of lasers also deeply concern the higher resolution. As disclosed in Japanese Patent Application Laid-Open No. 9-240051, the shorter oscillation wavelength a laser has, the smaller spot diameter the laser can have. This enables formation of latent images having a high resolution.

Some methods are available for making laser oscillation wavelength shorter.

One is a method in which a non-linear optical material is utilized so that the wavelength of laser light is shortened to half by using secondary higher harmonic generation (SHG) (e.g., Japanese Patent Application Laid-Open Nos. 9-275242, 9-189930 and 5-313033). This system can achieve a long life and a large output, since it can use GaAs semiconductor lasers or YAG lasers as primary light sources, which have already established their technique and can achieve a high output.

Another is a method in which a wide-gap semiconductor is used, and can make apparatus smaller in size than devices utilizing the SHG. ZnSe semiconductor lasers (e.g., Japanese Patent Application Laid-Open Nos. 7-321409 and 6-334272) and GaN semiconductor lasers (e.g., Japanese Patent Application Laid-Open Nos. 8-088441 and 7-335975) have long been studied in great deal because of their high emission efficiency.

It, however, has been difficult for these semiconductor lasers to be optimized in their device structure, crystal growth conditions and electrodes, and, because of defects in crystals, has been difficult to make long-time oscillation at room temperature, which is essential for putting them into practical use.

However, with progress of technological innovations on substrates and so forth, Nichia Kagaku Kogyo K.K. reported, in October, 1997, GaN semiconductor laser's continuous oscillation for 1,150 hours (condition: 50° C.), and materialization for its practical use stands close at hand.

Japanese Patent Application Laid-Open No. 9-240051 discloses as a photosensitive member suited for 400 nm to 500 nm lasers a multi-layer photosensitive member in which a single layer or charge generation layer making use of α-type titanyl phthalocyanine is formed as the outermost layer. Studies made by the present inventors, however, have revealed that the use of such a material brings about a problem that, because of a poor sensitivity and besides a very great memory especially for light of about 400 nm, photosensitive members may undergo great potential variations when used repeatedly.

SUMMARY OF THE INVENTION

An object of the present invention is to provide an electrophotographic photosensitive member having high sensitivity characteristics even in wavelength region of 380 nm to 500 nm and also having small photomemory and undergoing small potential variations when used repeatedly, and a process cartridge having such a photosensitive member, and also provides an electrophotographic apparatus that is practical and can stably reproduce images with a high image quality by using such a photosensitive member and a short wavelength laser.

The present invention provides an electrophotographic photosensitive member comprising a support and a photosensitive layer provided thereon, and being exposed to semiconductor laser light having a wavelength of from 380 nm to 500 nm;

the photosensitive layer containing a gallium phthalocyanine compound or an oxytitanium phthalocyanine compound having a strong peak at 27.2° plus-minus 0.2° of the diffraction angle in CuKα characteristic X-ray diffraction.

The present invention also provides a process cartridge having the electrophotographic photosensitive member described above.

The present invention still also provides an electrophotographic apparatus comprising the electrophotographic photosensitive member described above and a short-wavelength semiconductor laser as an exposure light source.

DESCRIPTION OF THE PREFERRED EMBODIMENTS

Figure 1:
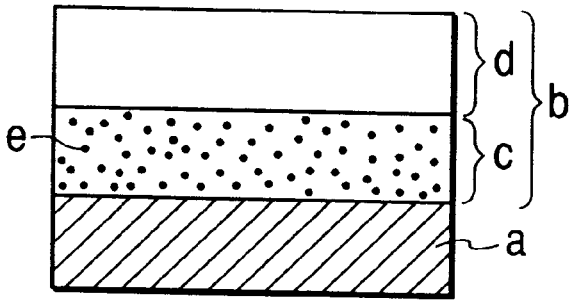
FIG. 1 is a cross-sectional view showing an example of layer configuration of the electrophotographic photosensitive member of the present invention.

The electrophotographic photosensitive member of the present invention is exposed to semiconductor laser light having a wavelength of from 380 nm to 500 nm and has a photosensitive layer containing a gallium phthalocyanine compound or an oxytitanium phthalocyanine compound having a strong peak at 27.2° plus-minus 0.2° of the diffraction angle in CuKα characteristic X-ray diffraction.

The gallium phthalocyanine compound (hereinafter "GaPC") used in the present invention is represented by the following formula.

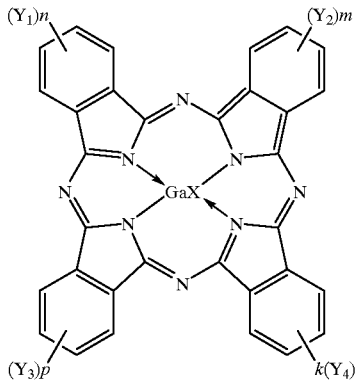

wherein X represents Cl, Br, I or OH; $Y_1$, $Y_2$, $Y_3$ and $Y_4$ each represent Cl or Br; and n, m, k and p each represent an integer of 0 to 4.

In the present invention, GaPCs having any crystal forms may be used, among which hydroxygallium phthalocyanine (hereinafter "HOGaPC") is preferred. In particular, an HOGaPC having strong peaks at 7.4° and 28.2° of the diffraction angle (2θ plus-minus 0.2°) in CuKα characteristic X-ray diffraction, as disclosed in, (e.g., Japanese Patent Application Laid-Open No. 5-263007) is preferred because it has a high sensitivity and the present invention can effectively operate.

The oxytitanium phthalocyanine compound (hereinafter "TiOPC") used in the present invention is represented by the following formula.

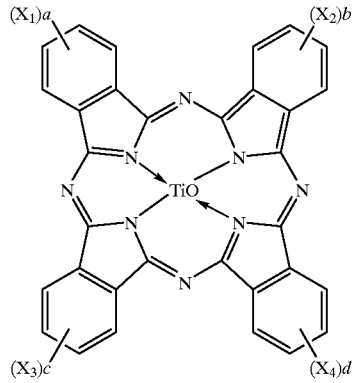

wherein $X_1$, $X_2$, $X_3$ and $X_4$ each represent Cl or Br; and a, b, c and d each represent an integer of 0 to 4.

The TiOPC used in the present invention may be any compound so long as it has a crystal form having a strong peak at 27.2° plus-minus 0.2° of the diffraction angle in CuKα characteristic X-ray diffraction. In particular, those having the following crystal forms are preferred, which are;

- a crystal form having strong peaks at 9.0°, 14.2°, 23.9° and 27.1° of the diffraction angle (2θ plus-minus 0.2° ) in CuKα characteristic X-ray diffraction, as disclosed in, e.g., Japanese Patent Application Laid-Open No. 3-128973;
- a crystal form having strong peaks at 9.6° and 27.3° of the diffraction angle (2θ plus-minus 0.2° ) in CuKα characteristic X-ray diffraction, as disclosed in, e.g., Japanese Patent Application Laid-Open No. 5-188614; and also
- a crystal form having strong peaks at 9.5°, 9.7°, 11.7°, 15.0°, 23.5°, 24.1°, and 27.3° of the diffraction angle (2θ plus-minus 0.2°) in CuKα characteristic X-ray diffraction, as disclosed in, e.g., Japanese Patent Application Laid-Open No. 64-17066.

Of these, the crystal form having strong peaks at 9.0°, 14.2°, 23.9° and 27.1° of the diffraction angle 2θ plus-minus 0.2°) in CuKα characteristic X-ray diffraction is particularly preferred.

The reason why the remarkable effect of the present invention is obtained is unclear, and is presumed as follows: The GaPC, and the TiOPC having specific crystal form may hardly cause photomemory even to short-wavelength light having an especially great energy and also, because of a high quantum efficiency or yield when short-wavelength light is used, may hardly deteriorate even due to the short-wavelength light having an especially great energy. Such properties of GaPC and TiOPC can not be expected at all from the conventionally known properties obtained when long-wavelength light is used.

The electrophotographic photosensitive member of the present invention will be described below in detail.

Figure 2:
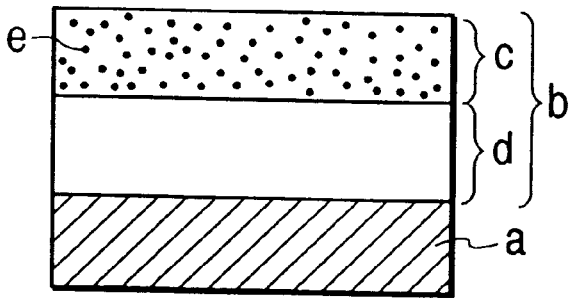
FIG. 2 is a cross-sectional view showing another example of layer configuration of the electrophotographic photosensitive member of the present invention.
Figure 3:
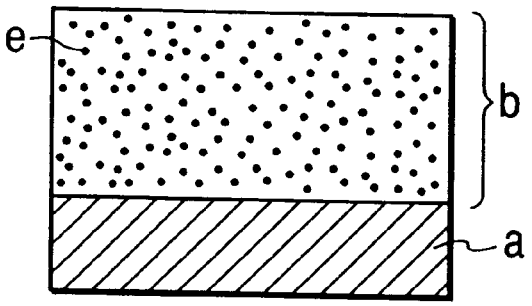
FIG. 3 is a cross-sectional view showing still another example of layer configuration of the electrophotographic photosensitive member of the present invention.

The photosensitive member may have any known layer configuration as shown in FIGS. 1 to 3. Preferred is the configuration as shown in FIG. 1. In FIGS. 1 to 3, letter symbol a denotes a support; b, a photosensitive layer; c, a charge generation layer; d, a charge transport layer; and e, a charge-generating material. Japanese Patent Application Laid-Open No. 9-240051 reports that, in the photosensitive member comprising the support and superposed thereon the charge generation layer and the charge transport layer in this order as shown in FIG. 1, the 400 nm to 500 nm light is absorbed in the charge transport layer before it reaches the charge generation layer, and hence no sensitivity is exhibited in theory. However, it does not necessarily apply. Even the photosensitive member having such layer configuration can have a sufficient sensitivity and can be used, so long as a charge-transporting material having properties of transmitting the light with laser's oscillation wavelength is used as the charge-transporting material used in the charge transport layer.

A function-separated photosensitive member comprising the support and superposed thereon the charge generation layer and the charge transport layer is produced in the manner described below.

The charge generation layer is formed by coating a fluid on the support by a known method, followed by drying; the fluid being prepared by dispersing the charge generating material (GaPC or TiOPC) in a suitable solvent together with a binder resin. The layer may preferably be formed in a thickness not larger than 5 μm, and particularly preferably from 0.1 μm to 1 μm.

The binder resin used may be selected from a vast range of insulating resins or organic photoconductive polymers. It may preferably include polyvinyl butyral, polyvinyl benzal, polyarylates, polycarbonates, polyesters, phenoxy resins, cellulose resins, acrylic resins and polyurethanes. Any of these resins may have a substituent, which substituent may preferably be a halogen atom, an alkyl group, an alkoxyl group, a nitro group, a cyano group or a trifluoromethyl group. The binder resin may be used in an amount of not more than 80% by weight, and particularly preferably not more than 40% by weight, based on the total weight of the charge generation layer.

The solvent used may preferably be selected from those which dissolve the binder resin and do not dissolve the charge transport layer and subbing layer described later. It may specifically include ethers such as tetrahydrofuran and 1,4-dioxane, ketones such as cyclohexanone and methyl ethyl ketone, amides such as N,N-dimethylformamide, esters such as methyl acetate and ethyl acetate, aromatics such as toluene, xylene and chlorobenzene, alcohols such as methanol, ethanol and 2-propanol, and aliphatic halogenated hydrocarbons such as chloroform, methylene chloride, dichloroethylene, carbon tetrachloride and trichloroethylene.

The charge transport layer is superposed on or beneath the charge generation layer, and has the function to accept charge carriers from the charge generation layer in the presence of an electric field and transport them. The charge transport layer is formed by coating a solution prepared by dissolving a charge-transporting material in a solvent optionally together with a suitable binder resin. It may preferably have a layer thickness of from 5 $\mu$m to 40 $\mu$m, and particularly preferably from 15 $\mu$m to 30 $\mu$m.

The charge-transporting material can roughly be grouped into an electron transporting material and a hole transporting material. The electron transporting material may include, e.g., electron attractive materials such as 2,4,7-trinitrofluolenone, 2,4,5,7-tetranitrofluolenone, chloranil and tetracyanoquinodimethane, and those obtained by forming these electron attractive materials into polymers. The hole transporting material may include, e.g., polycyclic aromatic compounds such as pyrene and anthracene, heterocyclic compounds such as compounds of carbazole type, indole type, oxazole type, thiazole type, oxadiazole type, pyrazole type, pyrazoline type, thiazole type or triazole type, hydrazone compounds, styryl compounds, benzidine compounds, triarylmethane compounds, triphenylamine compounds, or polymers having a group comprising any of these compounds as the backbone chain or side chain as exemplified by poly-N-vinylcarbazole and polyvinylanthracene.

These charge-transporting materials may be used alone or in combination of two or more. A suitable binder may be used when the charge-transporting material has no film forming properties. It may specifically include insulating resins such as acrylic resins, polyarylates, polycaronates, polyesters, polystyrene, acrylonitrile-styrene copolymer, polyacrylamides, polyamides and chlorinated rubbers, and organic photoconductive polymers such as poly-N-vinylcarbazole and polyvinylanthracene.

When used in the photosensitive member constituted as shown in FIG. 1, charge-transporting materials and binder resins which have transmission properties to the light with oscillation wavelength of semiconductor lasers used must be selected.

The support may be those having a conductivity and may include those made of, e.g., aluminum, an aluminum alloy, copper, zinc, stainless steel, vanadium, molybdenum, chromium, titanium, nickel, indium, gold and platinum. Besides, it is possible to use supports comprised of plastics (e.g., polyethylene, polypropylene, polyvinyl chloride, polyethylene terephthalate and acrylic resins) having a film formed by vacuum deposition of any of these metals or alloys, supports comprising any of the above plastics, metals or alloys covered thereon with conductive particles (e.g., carbon black and silver particles) together with a suitable binder resin, and supports comprising plastics or paper impregnated with the conductive particles. The support may be in the form of a drum, a sheet or a belt.

In the present invention, a subbing layer having a barrier function and an adhesion function may be provided between the support and the photosensitive layer.

A protective layer may also be provided for the purpose of protecting the photosensitive layer from any adverse mechanical and chemical effects.

Additives such as an antioxidant and an ultraviolet light absorber may also optionally be used in the photosensitive layer.

In the present invention, any exposure means may be used so long as it has as an exposure light source the semiconductor laser having an oscillation wavelength of 380 nm to 500 nm, and there are no particular limitations on other constitution. Also, there are no particular limitations on the semiconductor laser so long as its oscillation wavelength is within the above range. In the present invention, in view of electrophotographic performance, it is preferable for the semiconductor laser to have an oscillation wavelength of 400 nm to 450 nm.

There are also no particular limitations on the charging means, developing means, transfer means and cleaning means described later.

Figure 4:
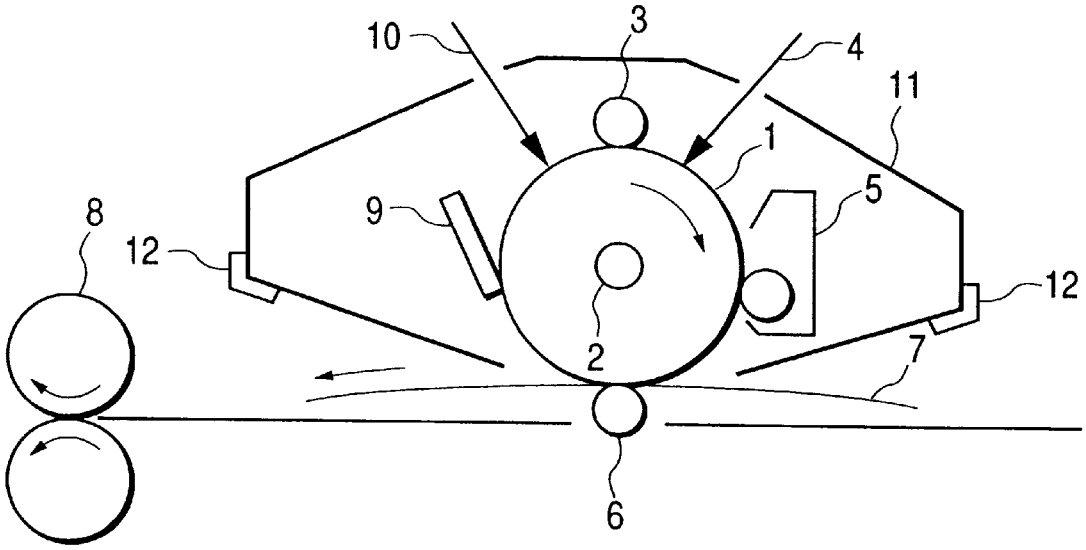
FIG. 4 schematically illustrates the construction of an electrophotographic apparatus having a process cartridge having the electrophotographic photosensitive member of the present invention.

FIG. 4 schematically illustrates the construction of an electrophotographic apparatus having a process cartridge having the electrophotographic photosensitive member of the present invention.

In FIG. 4, reference numeral 1 denotes an electrophotographic photosensitive member of the present invention, which is rotatingly driven around an axis 2 in the direction of an arrow at a given peripheral speed. The photosensitive member 1 is uniformly electrostatically charged on its periphery to a positive or negative, given potential through a primary charging means 3. The photosensitive member thus charged is then exposed to light 4 emitted from an exposure means (not shown) making use of a semiconductor laser having an oscillation wavelength of 380 nm to 500 nm. In this way, electrostatic latent images are successively formed on the periphery of the photosensitive member 1.

The electrostatic latent images thus formed are subsequently developed by toner by the operation of a developing means 5. The resulting toner-developed images are then successively transferred by the operation of a transfer means 6, to the surface of a transfer medium 7 fed from a paper feed section (not shown) to the part between the photosensitive member 1 and the transfer means 6 in the manner synchronized with the rotation of the photosensitive member 1.

The transfer medium 7 to which the images have been transferred is separated from the surface of the photosensitive member, is led to an image fixing means 8, where the images are fixed, and is then printed out of the apparatus as a copied material (a copy).

The surface of the photosensitive member 1 after the transfer of images is brought to removal of the toner remaining after the transfer, through a cleaning means 9. Thus, the photosensitive member is cleaned on its surface, further subjected to charge elimination by pre-exposure light 10 emitted from a pre-exposure means (not shown), and then repeatedly used for the formation of images. In the apparatus shown in FIG. 4, the primary charging means is a contact charging means making use of a charging roller, and hence the pre-exposure is not necessarily required.

In the present invention, the apparatus may be constituted of a combination of plural components integrally joined as a process cartridge from among the constituents such as the above electrophotographic photosensitive member 1, primary charging means 3, developing means 5 and cleaning means 9 so that the process cartridge is detachably mountable to the body of the electrophotographic apparatus such as a copying machine or a laser beam printer. For example, at least one of the primary charging means 3, the developing means 5 and the cleaning means 9 may integrally be supported in a cartridge together with the electrophotographic photosensitive member 1 to form a process cartridge 11 that is detachably mountable to the body of the apparatus through a guide means such as a rail 12 provided in the body of the apparatus.

Production examples for the GaPC used in the present invention are given below. In the following Production Examples and also in the subsequent Examples, "part(s)" indicates part(s) by weight.

PRODUCTION EXAMPLE 1

73 parts of o-phthalodinytrile, 25 parts of gallium trichloride and 400 parts of α-chloronaphthalene were allowed to react at 200° C. for 4 hours in an atmosphere of nitrogen, and thereafter the product was filtered at 130° C. The resultant product was dispersed and washed at 130° C. for 1 hour using N,N'-dimethylformamide, followed by filtration and then washing with methanol, further followed by drying to obtain 45 parts of chlorogallium phthalocyanine. Elemental analysis of this compound revealed the following. Values of elemental analysis ($C_{32}H_{16}N_8ClGa$)

| | C | H | N | Cl |
|---|---|---|---|---|
| Found (%): | 61.8 | 2.7 | 18.3 | 6.3 |
| Calculated (%): | 62.2 | 2.6 | 18.1 | 5.7 |

PRODUCTION EXAMPLE 2

15 parts of the chlorogallium phthalocyanine obtained in Production Example 1 was dissolved in 450 parts of 10° C. concentrated sulfuric acid, and the solution obtained was added dropwise in 2,300 parts of ice water with stirring to effect re-precipitation, followed by filtration. The filtrate obtained was dispersed and washed with 2% aqueous ammonia, and then thoroughly washed with ion-exchanged water, followed by filtration and drying to obtain 13 parts of low-crystalline HOGaPC. Elemental analysis of this compound revealed the following. Values of elemental analysis ($C_{32}H_{17}N_8OGa$)

| | C | H | N | Cl |
|---|---|---|---|---|
| Found (%): | 62.8 | 2.6 | 18.3 | 0.5 |
| Calculated (%): | 64.1 | 2.9 | 18.7 | — |

PRODUCTION EXAMPLE 3

5 parts of the chlorogallium phthalocyanine obtained in Production Example 1 was treated by milling at room temperature (22° C.) for 24 hours using 300 parts of glass beads of 1 mm diameter, and thereafter 200 parts of benzyl alcohol was added, followed by further milling at room temperature (22° C.) for 6 hours. From the resultant dispersion, solid matter was taken out and then dried to obtain 4.5 parts of chlorogallium phthalocyanine. This chlorogallium phthalocyanine had strong peaks at 7.4°, 16.6°, 25.5° and 28.3° of the diffraction angle (2θ plus-minus 0.2°) in CuKα characteristic X-ray diffraction. This chlorogallium phthalocyanine is disclosed in Japanese Patent Application Laid-Open No. 5-98181.

PRODUCTION EXAMPLE 4

10 parts of the HOGaPC obtained in Production Example 2 and 300 parts of N,N'-dimethylformamide were treated by milling at room temperature (22° C.) for 6 hours using 450 parts of glass beads of 1 mm diameter.

From the resultant dispersion, solid matter was taken out and then displaced with methanol and dried to obtain 9.2 parts of HOGaPC. This HOGaPC had strong peaks at 7.4° and 28.2° of the diffraction angle (2θ plus-minus 0.2°) in CuKα characteristic X-ray diffraction. This HOGaPC is disclosed in Japanese Patent Application Laid-Open No. 5-263007.

PRODUCTION EXAMPLE 5

10 parts of the HOGaPC obtained in Production Example 2 and 300 parts of N,N'-dimethylaniline were treated by milling at room temperature (22° C.) for 6 hours using 450 parts of glass beads of 1 mm diameter.

From the resultant dispersion, solid matter was taken out and then displaced and washed with methanol and dried to obtain 9.2 parts of HOGaPC. This HOGaPC had strong peaks at 7.6°, 16.4°, 25.0° and 26.5° of the diffraction angle (2θ plus-minus 0.2°) in CuKα characteristic X-ray diffraction. This HOGaPC is disclosed in Japanese Patent Application Laid-Open No. 5-263007.

PRODUCTION EXAMPLE 6

10 parts of the HOGaPC obtained in Production Example 2 and 300 parts of chloroform were treated by milling at room temperature (22° C.) for 6 hours using 450 parts of glass beads of 1 mm diameter.

From the resultant dispersion, solid matter was taken out and then dried to obtain 9.2 parts of HOGaPC. This HOGaPC had strong peaks at 6.9°, 16.5° and 26.7° of the diffraction angle (2θ plus-minus 0.2°) in CuKα characteristic X-ray diffraction. This HOGaPC is disclosed in Japanese Patent Application Laid-Open No. 6-279698.

Production Examples of the TiOPC used in the present invention are shown below.

PRODUCTION EXAMPLE 7

5.0 parts of o-phthalodinitrile and 2.0 parts of titanium tetrachloride were heated and stirred at 200° C. for 3 hours in 100 parts of α-chloronaphthalene, and thereafter cooled to 50° C. Crystals thus precipitated were filtered to obtain a paste of dichlorotitanium phthalocyanine. Next, this paste was washed, with stirring, with 100 parts of N,N'-dimethylformamide heated to 100° C., and then washed repeatedly with 100 parts of 60° C. methanol twice, followed by filtration. The resultant paste was further stirred at 80° C. for 1 hour in 100 parts of deionized water, followed by filtration to obtain blue TiOPC. Yield: 4.3 parts.

Next, the crystals obtained were dissolved in 30 parts of concentrated sulfuric acid, and the solution formed was added dropwise in 300 parts of 20° C. deionized water with stirring to effect re-precipitation, followed by filtration and thorough washing with water to obtain amorphous TiOPC. Then, 4.0 parts of the amorphous TiOPC thus obtained was treated by suspension and stirring in 100 parts of methanol at room temperature (22° C.) for 8 hours, followed by filtration and drying under reduced pressure to obtain low-crystalline TiOPC. Next, to 2.0 parts of this TiOPC, 40 parts of n-butyl ether was added to make treatment by milling at room temperature (22° C.) for 20 hours using glass beads of 1 mm diameter.

From the resultant dispersion, solid matter was taken out and thoroughly washed with methanol and then water, followed by drying to obtain novel crystal TiOPC of the present invention. Yield: 1.8 parts. This TiOPC had strong peaks at 9.0°, 14.2°, 23.9° and 27.1° of the diffraction angle (2θ plus-minus 0.2°) in CuKα characteristic X-ray diffraction.

PRODUCTION EXAMPLE 8

Production Example disclosed in Japanese Patent Application Laid-Open No. 64-17066 was carried out to obtain TiOPC having a crystal form having strong peaks at 9.5°, 9.7°, 11.6°, 14.9°, 24.0° and 27.3° of the diffraction angle (2θ plus-minus 0.2°) in CuKα characteristic X-ray diffraction.

PRODUCTION EXAMPLE 9

Production Example disclosed in Japanese Patent Application Laid-Open No. 5-188614 was carried out to obtain TiOPC having a crystal form having strong peaks at 9.6° and 27.3° of the diffraction angle (2θ plus-minus 0.2°) in CuKα characteristic X-ray diffraction.

COMPARATIVE PRODUCTION EXAMPLE 1

Production Example disclosed in Japanese Patent Application Laid-Open No. 61-239248 (U.S. Pat. No. 4,728,592) was carried out to obtain TiOPC having a crystal form of what is called α-type, having no strong peak at 27.2° plus-minus 0.2° of the diffraction angle in CuKα characteristic X-ray diffraction. The present invention will be described below by giving Examples.

EXAMPLE 1

On an aluminum substrate, a solution prepared by dissolving 5 parts of methoxymethylated nylon (average molecular weight: 32,000) and 10 parts of alcohol-soluble copolymer nylon (average molecular weight: 29,000) in 95 parts of methanol was coated by Mayer-bar coating, followed by drying to form a subbing layer with a layer thickness of 1 μm.

Next, 4 parts of the GaPC obtained in Production Example 3 was added in a solution prepared by dissolving 2 parts of butyral resin (degree of butyralation: 63 mole %; weight-average molecular weight: 100,000) in 95 parts of cyclohexanone and was dispersed for 20 hours using a sand mill. The dispersion thus obtained was coated on the subbing layer by Mayer-bar coating, followed by drying to form a charge generation layer with a layer thickness of 0.2 μm.

Subsequently, a solution prepared by dissolving 5 parts of a charge-transporting material represented by the following structural formula:

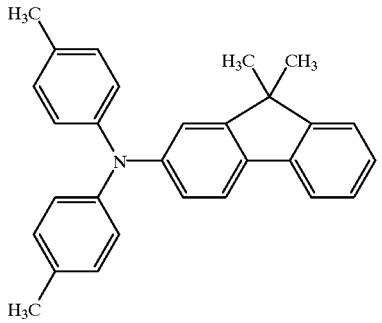

and 5.5 parts of bisphenol-Z polycarbonate resin (number-average molecular weight: 20,000) in 40 parts of chlorobenzene was coated on the charge generation layer by Mayer-bar coating, followed by drying to form a charge transport layer with a layer thickness of 20 μm. Thus, an electrophotographic photosensitive member was produced.

The electrophotographic photosensitive member thus produced was evaluated in the following way, using an electrostatic copy paper test apparatus (EPA-8100, manufactured by Kawaguchi Denki).

Sensitivity:

The photosensitive member was electrostatically charged by a corona charging assembly so as to have a surface potential of −700 V, and then exposed to monochromatic light of 400 nm isolated with a monochromator, where the amount of light necessary for the surface potential to attenuate to −350 V was measured to determine sensitivity (E ½). Sensitivities at monochromatic light of 450 nm and 500 nm were also measured in the same way.

Repetition Performance:

Next, initial dark-area potential (Vd) and initial light-area potential (Vl) were set at about −700 V and −200 V, respectively, and charging and exposure were repeated 3,000 times using monochromatic light of 400 nm to measure variations of Vd and Vl (ΔVd, ΔVl).

Photomemory:

The initial Vd and 400 nm monochromatic light initial Vl of the photosensitive member were set at about −700 V and −200 V, respectively. Then, the photosensitive member was partly irradiated by 400 nm monochromatic light of 20 μW/cm2 in light intensity for 15 minutes, and thereafter the Vd and Vl of the photosensitive member was again measured, thus the difference in Vd between non-irradiated areas and irradiated areas ($\Delta Vd_{PM}$) and the difference in Vl between non-irradiated areas and irradiated areas ($\Delta Vl_{PM}$) were measured.

Results obtained are shown in Table 1.

In the following table, the minus signs in the data of repetition performance and photomemory denote a decrease in potential, and the plus signs an increase in potential.

EXAMPLES 2 TO 4 AND COMPARATIVE EXAMPLE 1

Electrophotographic photosensitive members were produced in the same manner as in Example 1 except that the materials shown in Table 1 were each used as the charge-transporting material. Evaluation was made similarly.

Results obtained are shown in Table 1.

EXAMPLES 5 TO 8 AND COMPARATIVE EXAMPLE 2

Electrophotographic photosensitive members were produced in the same manner as in Examples 1 to 4 and Comparative Example 1, respectively, except that the order of the charge generation layer and charge transport layer was reversed. Initial sensitivities were measured in the same manner as in Example 1, provided that the charge-transporting material was replaced with a compound having the following structure and charge polarity was set positive.

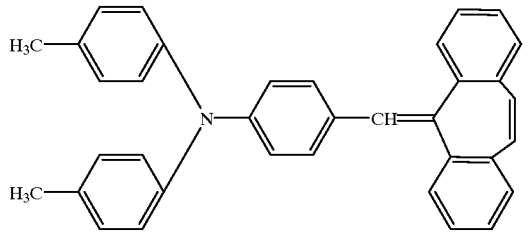

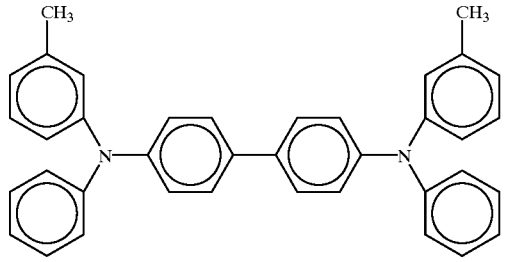

Results obtained are shown together in Table 2.

As can be seen from the above results, compared with the electrophotographic photosensitive member of Comparative Example, the electrophotographic photosensitive members of the present invention have a very superior sensitivity in the oscillation wavelength region of 400 nm to 500 nm short-wavelength lasers, and moreover show small photomemory to short-wavelength light and has a superior stability in potential and sensitivity in repeated use.

EXAMPLES 9 TO 12

50 parts of titanium oxide powder coated with tin oxide containing 10% of antimony oxide, 25 parts of resol type phenol resin, 20 parts of methyl cellosolve, 5 parts of methanol and 0.002 part of silicone oil (polydimethylsiloxane-polyoxyalkylene copolymer; average molecular weight: 30,000) were dispersed for 2 hours by means of a sand mill making use of glass beads of 1 mm diameter to prepare a conductive layer coating fluid. This coating fluid was dip-coated on an aluminum cylinder, followed by drying at 140° C. for 30 minutes to form a conductive layer with a layer thickness of 20 μm.

A solution was prepared by dissolving 5 parts of a 6-66-610-12 polyamide quadripolymer in a mixed solvent of 70 parts of methanol and 25 parts of butanol. This solution was dip-coated on the conductive layer, followed by drying to form a subbing layer with a layer thickness of 0.8 μm.

Next, to a solution prepared by dissolving 5 parts of polyvinyl butyral (trade name: S-LEC BM-S; available from Sekisui Chemical Co., Ltd.) in 100 parts of cyclohexanone, 10 parts of the charge-transporting material shown in Table 3 was added. The resulting mixture was dispersed for 20 hours by means of a sand mill making use of glass beads of 1 mm diameter. To the dispersion thus obtained, 100 parts of methyl ethyl ketone was further added to dilute it. The dispersion thus obtained was dip-coated on the above subbing layer, followed by drying at 100° C. for 10 minutes to form a charge generation layer with a layer thickness of 0.2 μm.

Next, 9 parts of a charge-transporting material represented by the following structural formula:

and 10 parts of bisphenol-Z polycarbonate resin (number-average molecular weight: 20,000) were dissolved in 60 parts of monochlorobenzene. The resulting solution was dip-coated on the charge generation layer, followed by drying at a temperature of 110° C. for 1 hour to form a charge transport layer with a layer thickness of 20 μm. Thus, electrophotographic photosensitive members of Examples 9 to 12 were produced.

The electrophotographic photosensitive members thus produced were each set in a CANON's printer LBP-2000 modified machine loaded with a pulse-modulating unit (as a light source, loaded with a full-solid blue SHG laser ICD-430, having an oscillation wavelength of 430 nm, manufactured by Hitachi Metals, Ltd.; also modified into a Carlson-type electrophotographic system consisting of charging, exposure, development, transfer and cleaning, adaptable to image input corresponding to 600 dpi in reverse development). The dark-area potential Vd and light-area potential Vl were set at −650 V and −200 V, respectively, and one-dot/one-space images and character (5 point) images were reproduced, and images formed were visually evaluated.

COMPARATIVE EXAMPLE 3

Images were evaluated in the same manner as in Example 9 except that the light source of the evaluation machine was replaced with a GaAs semiconductor laser having an oscillation wavelength of 780 nm.

Results obtained are shown in Table 3.

As can be seen from these results, the electrophotographic photosensitive members of the present invention can form images having superior dot reproducibility and character reproducibility and a high resolution.

EXAMPLES 13 TO 15

Electrophotographic photosensitive members were produced in the same manner as in Example 1 except that the charge-generating material was replaced with those shown in Table 4. Evaluation was made similarly. Results obtained are shown in Table 4.

EXAMPLES 16 TO 18

Electrophotographic photosensitive members were produced in the same manner as in Example 5 except that the charge-generating material was replaced with those shown in Table 5. Evaluation was made similarly.

Results obtained are shown in Table 5.

As can be seen from the above results, compared with the electrophotographic photosensitive member of Comparative Example, the electrophotographic photosensitive members of the present invention have a very superior sensitivity in the oscillation wavelength region of 400 nm to 500 nm short-wavelength lasers, and moreover show small photomemory to short-wavelength light and has a superior stability in potential and sensitivity in repeated use.

EXAMPLES 19 TO 21

Electrophotographic photosensitive members were produced in the same manner as in Example 9 except that the charge-generating material was replaced with those shown in Table 6. Evaluation was made similarly.

Results obtained are shown in Table 6.

As can be seen from these results, the electrophotographic photosensitive members of the present invention can form images having superior dot reproducibility and character reproducibility and a high resolution.

TABLE 1

| Example: | Charge generating material (Production Example No.) | Sensitivity E½ (μJ/cm²) 400 nm | 450 nm | 500 nm | Repetition performance (V) ΔVd | ΔV1 | Photomemory (V) $\Delta Vd_{PM}$ | $\Delta V1_{PM}$ |
|---|---|---|---|---|---|---|---|---|
| 1 | 3 | 0.90 | 1.55 | 1.47 | 0 | +20 | −10 | 0 |
| 2 | 4 | 0.43 | 0.80 | 0.70 | 0 | +10 | −10 | 0 |
| 3 | 5 | 0.93 | 1.42 | 1.35 | −5 | +15 | −10 | 0 |
| 4 | 6 | 1.05 | 1.50 | 1.45 | −10 | +10 | −10 | 0 |
| Comparative Example: | | | | | | | | |
| 1 | 1* | 1.12 | 3.50 | 2.67 | −110 | −85 | −230 | −150 |

*Comparative Production Example No.

TABLE 2

| Example | Charge-generating material (Production Example No.) | Sensitivity E½ (μJ/cm²) 400 nm | 450 nm | 500 nm |
|---|---|---|---|---|
| 5 | 3 | 0.92 | 1.54 | 1.48 |
| 6 | 4 | 0.43 | 0.82 | 0.68 |
| 7 | 5 | 0.93 | 1.52 | 1.42 |
| 8 | 6 | 1.10 | 1.53 | 1.47 |
| Comparative Example: | | | | |
| 2 | 1* | 1.23 | 4.02 | 2.93 |

*Comparative Production Example No.

TABLE 3

| Example | Charge generating material (Production Example No.) | Dot reproducibility | Character reproducibility |
|---|---|---|---|
| 9 | 3 | sharp | sharp |
| 10 | 4 | sharp | sharp |
| 11 | 5 | sharp | sharp |
| 12 | 6 | sharp | sharp |

TABLE 3-continued

| | Charge generating material | Dot reproducibility | Character reproducibility |
|---|---|---|---|
| Comparative Example: | | | |
| 3 | 3 | not reproduced | unsharp (trailed in the direction of secondary scanning |

TABLE 4

| Example: | Charge generating material (Production Example No.) | Sensitivity E½ (μJ/cm²) 400 nm | 450 nm | 500 nm | Repetition performance (V) ΔVd | ΔV1 | Photomemory (V) $\Delta Vd_{PM}$ | $\Delta V1_{PM}$ |
|---|---|---|---|---|---|---|---|---|
| 13 | 7 | 0.30 | 0.52 | 0.43 | 0 | −10 | −100 | −30 |
| 14 | 8 | 0.35 | 0.60 | 0.50 | −10 | −30 | −150 | −90 |
| 15 | 9 | 0.33 | 0.57 | 0.48 | −10 | −30 | −140 | −95 |

TABLE 5

| Example | Charge-generating material (Production Example No.) | Sensitivity E½ (μJ/cm²) 400 nm | 450 nm | 500 nm |
|---|---|---|---|---|
| 16 | 7 | 0.32 | 0.55 | 0.50 |
| 17 | 8 | 0.40 | 0.65 | 0.55 |
| 18 | 9 | 0.38 | 0.61 | 0.52 |

TABLE 6

| Example | Charge generating material (Production Example No.) | Dot reproducibility | Character reproducibility |
|---|---|---|---|
| 19 | 7 | sharp | sharp |
| 20 | 8 | sharp | sharp |
| 21 | 9 | sharp | sharp |

What is claimed is:

1. An electrophotographic photosensitive member comprising a support and a photosensitive layer provided thereon, said photosensitive layer being sensitive to semiconductor laser light having a wavelength of from 380 nm to 500 nm;

said photosensitive layer containing a gallium phthalocyanine compound, or an oxytitanium phthalocyanine compound having a strong peak at 27.2° plus-minus 0.2° of the diffraction angle in CuKα characteristic X-ray diffraction.

2. The electrophotographic photosensitive member according to claim 1, wherein said photosensitive layer contains the gallium phthalocyanine compound.

3. The electrophotographic photosensitive member according to claim 1 or 2, wherein said gallium phthalocyanine compound is hydroxygallium phthalocyanine.

4. The electrophotographic photosensitive member according to claim 3, wherein said hydroxygallium phthalocyanine has strong peaks at 7.4° and 28.2° of the diffraction angle (2θ plus-minus 0.2°) in CuKα characteristic X-ray diffraction.

5. The electrophotographic photosensitive member according to claim 1, wherein said photosensitive layer contains the oxytitanium phthalocyanine compound having a strong peak at 27.2° plus-minus 0.2° of the diffraction angle in CuKα characteristic X-ray diffraction.

6. The electrophotographic photosensitive member according to claim 1 or 5, wherein said oxytitanium phthalocyanine compound has strong peaks at 9.0°, 14.2°, 23.9° and 27.1° of the diffraction angle (2θ plus-minus 0.2°) in CuKα characteristic X-ray diffraction.

7. The electrophotographic photosensitive member according to claim 1 or 5, wherein said oxytitanium phthalocyanine compound has strong peaks at 9.6° and 27.3° of the diffraction angle (2θ plus-minus 0.2°) in CuKα characteristic X-ray diffraction.

8. The electrophotographic photosensitive member according to claim 1 or 5, wherein said oxytitanium phthalocyanine compound has strong peaks at 9.5°, 9.7°, 11.7°, 15.0°, 23.5°, 24.1°, and 27.3° of the diffraction angle (2θ plus-minus 0.2°) in CuKα characteristic X-ray diffraction.

9. The electrophotographic photosensitive member according to claim 1, wherein the wavelength the semiconductor laser light has is from 400 nm to 450 nm.

10. A process cartridge comprising an electrophotographic photosensitive member and a means selected from the group consisting of a charging means, a developing means and a cleaning means;

said electrophotographic photosensitive member and at least one of said means being supported as one unit and being detachably mountable to the main body of an electrophotographic apparatus; and said electrophotographic photosensitive member comprising a support and a photosensitive layer provided thereon, said photosensitive layer being sensitive to semiconductor laser light having a wavelength of from 380 nm to 500 nm;

said photosensitive layer containing a gallium phthalocyanine compound, or an oxytitanium phthalocyanine compound having a strong peak at 27.2° plus-minus 0.2° of the diffraction angle in CuKα characteristic X-ray diffraction.

11. The process cartridge according to claim 10, wherein said photosensitive layer contains the gallium phthalocyanine compound.

12. The process cartridge according to claim 10 or 11, wherein said gallium phthalocyanine compound is hydroxygallium phthalocyanine.

13. The process cartridge according to claim 12, wherein said hydroxygallium phthalocyanine has strong peaks at 7.4° and 28.2° of the diffraction angle (2θ plus-minus 0.2°) in CuKα characteristic X-ray diffraction.

14. The process cartridge according to claim 10, wherein said photosensitive layer contains the oxytitanium phthalocyanine compound having a strong peak at 27.2° plus-minus 0.2° of the diffraction angle in CuKα characteristic X-ray diffraction.

15. The process cartridge according to claim 10 or 14, wherein said oxytitanium phthalocyanine compound has strong peaks at 9.0°, 14.2°, 23.9° and 27.1° of the diffraction angle (2θ plus-minus 0.2°) in CuKα characteristic X-ray diffraction.

16. The process cartridge according to claim 10 or 14, wherein said oxytitanium phthalocyanine compound has strong peaks at 9.6° and 27.3° of the diffraction angle (2θ plus-minus 0.2°) in CuKα characteristic X-ray diffraction.

17. The process cartridge according to claim 10 or 14, wherein said oxytitanium phthalocyanine compound has strong peaks at 9.5°, 9.7°, 11.7°, 15.0°, 23.5°, 24.1°, and 27.3° of the diffraction angle (2θ plus-minus 0.2°) in CuKα characteristic X-ray diffraction.

18. The process cartridge according to claim 10, wherein the wavelength the semiconductor laser light has is from 400 nm to 450 nm.

19. An electrophotographic apparatus comprising an electrophotographic photosensitive member, a charging means, an exposure means, a developing means and a transfer means;

said exposure means having a semiconductor laser having an oscillation wavelength of from 380 nm to 500 nm as an exposure light source; and said electrophotographic photosensitive member comprising a support and a photosensitive layer provided thereon;

said photosensitive layer containing a gallium phthalocyanine compound, or an oxytitanium phthalocyanine compound having a strong peak at 27.2° plus-minus 0.2° of the diffraction angle in CuKα characteristic X-ray diffraction.

20. The electrophotographic apparatus according to claim 19, wherein said photosensitive layer contains the gallium phthalocyanine compound.

21. The electrophotographic apparatus according to claim 19 or 20, wherein said gallium phthalocyanine compound is hydroxygallium phthalocyanine.

22. The electrophotographic apparatus according to claim 21, wherein said hydroxygallium phthalocyanine has strong peaks at 7.4° and 28.2° of the diffraction angle (2θ plus-minus 0.2°) in CuKα characteristic X-ray diffraction.

23. The electrophotographic apparatus according to claim 19, wherein said photosensitive layer contains the oxytitanium phthalocyanine compound having a strong peak at 27.2° plus-minus 0.2° of the diffraction angle in CuKα characteristic X-ray diffraction.

24. The electrophotographic apparatus according to claim 19 or 23, wherein said oxytitanium phthalocyanine compound has strong peaks at 9.0°, 14.2°, 23.9° and 27.1° of the diffraction angle (2θ plus-minus 0.2°) in CuKα characteristic X-ray diffraction.

25. The electrophotographic apparatus according to claim 19 or 23, wherein said oxytitanium phthalocyanine compound has strong peaks at 9.6° and 27.3° of the diffraction angle (2θ plus-minus 0.2°) in CuKα characteristic X-ray diffraction.

26. The electrophotographic apparatus according to claim 19 or 23, wherein said oxytitanium phthalocyanine compound has strong peaks at 9.5°, 9.7°, 11.7°, 15.0°, 23.5°, 24.1°, and 27.3° of the diffraction angle (2θ plus-minus 0.2°) in CuKα characteristic X-ray diffraction.

27. The electrophotographic apparatus according to claim 19, wherein said semiconductor laser light has an oscillation wavelength of from 400 nm to 450 nm.

* * * * *